US007759593B2

(12) United States Patent
Wang

(10) Patent No.: US 7,759,593 B2
(45) Date of Patent: Jul. 20, 2010

(54) BUTTON MODULE HAVING AN AUTOMATIC RESET FUNCTION

(75) Inventor: Tsung-Chin Wang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/102,624

(22) Filed: Apr. 14, 2008

(65) Prior Publication Data

US 2009/0152087 A1 Jun. 18, 2009

(30) Foreign Application Priority Data

Dec. 14, 2007 (CN) ..... 2007 1 0203062

(51) Int. Cl.
*H01H 13/00* (2006.01)
*H01H 3/00* (2006.01)

(52) U.S. Cl. ..... 200/339; 200/553

(58) Field of Classification Search ..... 200/339
See application file for complete search history.

(56) References Cited

U.S. PATENT DOCUMENTS 4,975,547 A * 12/1990 Nakayama et al. ..... 200/5 R
6,956,179 B2 * 10/2005 Gillman et al. ..... 200/302.3
6,963,039 B1 * 11/2005 Weng et al. ..... 200/302.1
6,974,919 B2 * 12/2005 Mori et al. ..... 200/5 R
7,105,762 B1 * 9/2006 Lee ..... 200/449
2007/0246340 A1 * 10/2007 Zhao et al. ..... 200/339

FOREIGN PATENT DOCUMENTS

CN 1212446 A 3/1999
JP 11-73840 A 3/1999

* cited by examiner

*Primary Examiner*—Michael A Friedhofer
*Assistant Examiner*—Lheiren Mae A Caroc
(74) *Attorney, Agent, or Firm*—Frank R. Niranjan

(57) ABSTRACT

A button module adapted for use in an electronic device includes a cover, a button pivotably engaged with the cover, and an elastic plate secured on the cover and attaching to the button. When the button moves relative to the cover from a first position to a second position, the plate generates elastic distortion and abuts against the button to reset the button to the first position.

12 Claims, 5 Drawing Sheets

BUTTON MODULE HAVING AN AUTOMATIC RESET FUNCTION

BACKGROUND

1. Field of the Invention

The present invention relates to a button module, particularly to a button module having an automatic reset function, which is used in a portable electronic device such as a digital camera.

2. Description of related art

With the development of the optical imaging technology, camera devices are becoming widely used in electronic devices, such as digital cameras and digital videos.

In a typical camera module, a lens module is a very important element in producing high quality pictures. Generally, a lens module provides a focusing system for users to just press a button thereof to complete a focusing process. The focusing system conventionally includes a spring to reset the button back to an original position.

However, because of limited inner space of the camera module, the spring must be very small, which results in difficult assembly of the camera module. Additionally, because the spring is so small, elastic force of the spring is weak, which may lead to unreliable performance of the focusing system.

What is needed, therefore, is an improved button module in a focusing module of a camera which can overcome the above mentioned problems.

SUMMARY

A button module adapted for use in an electronic device includes a cover, a button pivotably engaged with the cover, and an elastic plate secured on the cover and attaching to the button. When the button moves relative to the cover from a first position to a second position, the plate generates elastic distortion and abuts against the button to reset the button to the first position.

Other advantages and novel features of the present invention will become more apparent from the following detailed description when taken in conjunction with the accompanying drawings.

DETAILED DESCRIPTION OF THE EMBODIMENT

Figure 1:
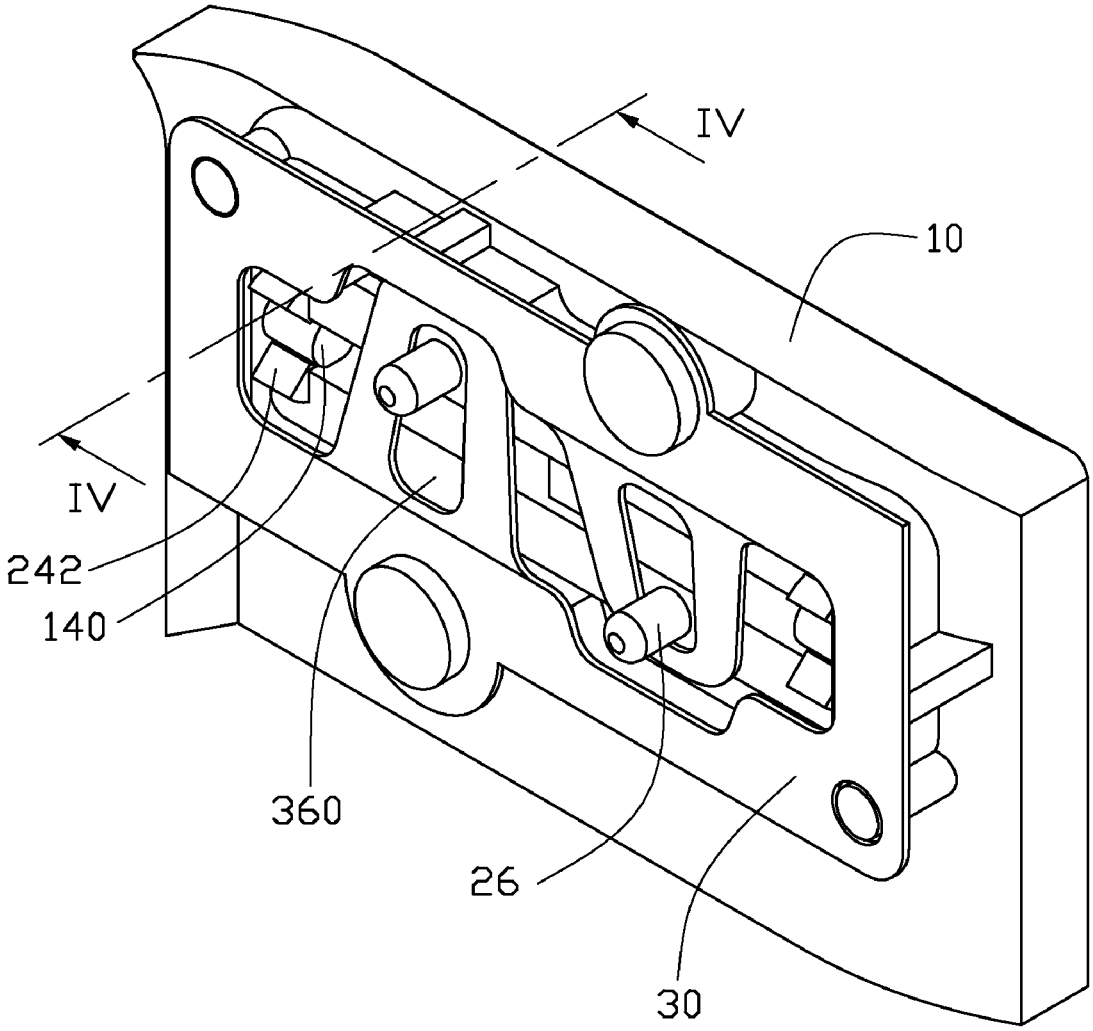
FIG. 1 is an isometric, assembled view of a button module in accordance with a preferred embodiment of the present invention.
Figure 2:
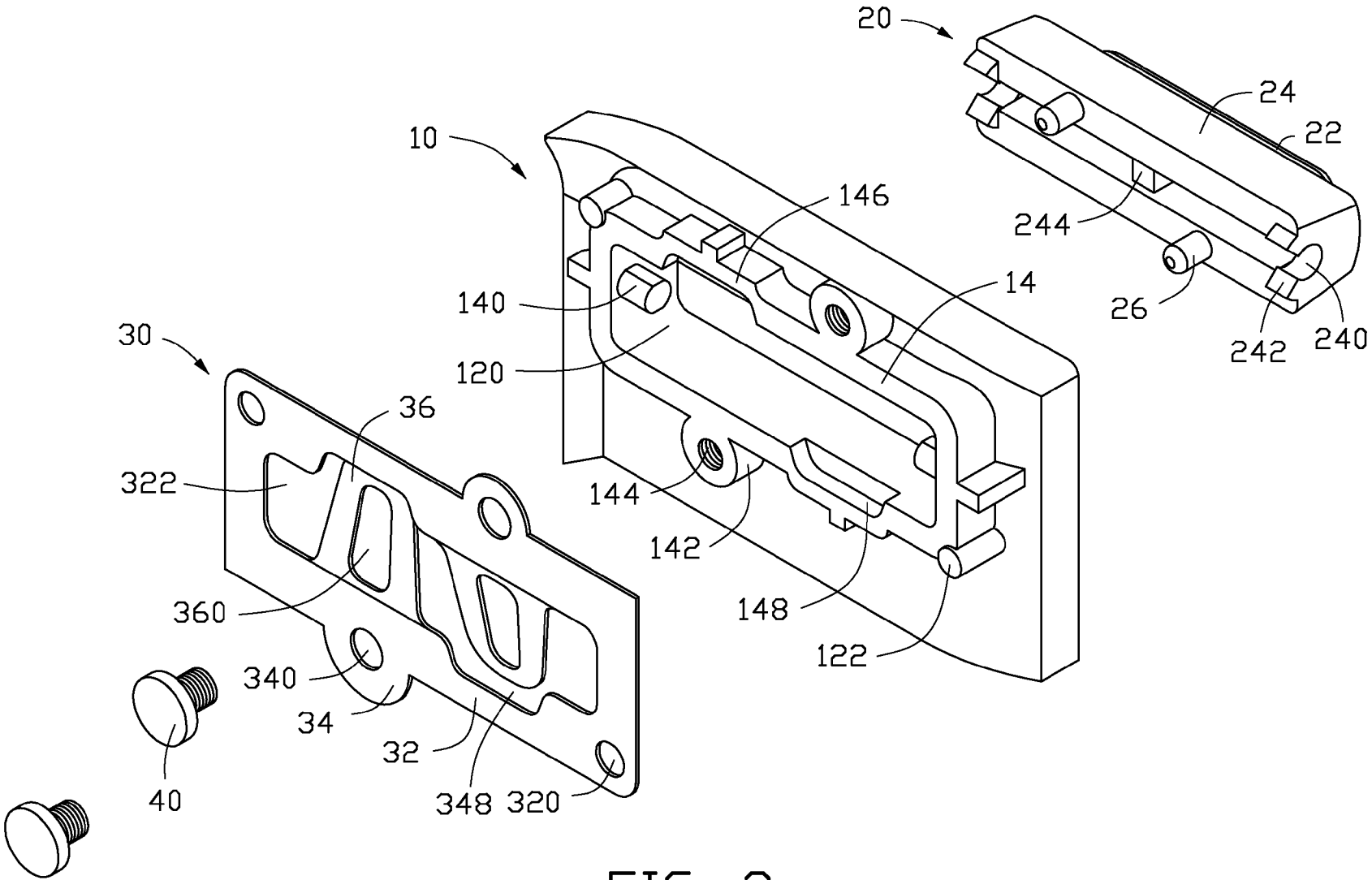
FIG. 2 is an isometric, exploded view of the button module in FIG. 1.

Referring to FIGS. 1-2, a button module used in an electronic device such as a digital camera (not shown) for adjusting focus of a lens of the camera in accordance with an exemplary embodiment of the present invention is shown.

The button module comprises a cover 10, a button 20 pivotably engaged with the cover 10, and an elastic plate 30 secured on the cover 10.

The cover 10 is actually a part of a back plate of the camera and has a substantially rectangular configuration. A substantially rectangular opening 120 is defined in a center of the cover 10 for receiving the button 20 therein. A rectangular sidewall 14 extends from a front side of the cover 10 and surrounds the opening 120. Two positioning columns 122 are formed on two diagonal corners of the sidewall 14 respectively. A height of the positioning columns 122 is greater than that of the sidewall 14, that is to say, a top of the positioning columns 122 is slightly above a top of the sidewall 14. The positioning columns 122 are used to position the plate 30 relative to the sidewall 14 of the cover 10.

Two pivots 140 extend inwardly and symmetrically from two opposite short sides of the sidewall 14 respectively. The two pivots 140 are substantially cylindrical and partial surfaces thereof are cut flat for conveniently engaging with the button 20. Two platforms 142 protrude out from opposite long sides of the sidewall 14 out of alignment. The two platforms 142 are substantially cylindrical and have the same height as that of the sidewall 14 such that a top surface of the two platforms 142 and a top surface of the sidewall 14 are in a same level. A threaded hole 144 is defined in each of the platforms 142 for receiving screws 40 therein. The two long sides of the sidewall 14 are stamped at sides of the platforms 142 to form two protrusions 146 protruding outwardly; simultaneously, two concave portions 148 are defined at inner surfaces of the two long sides of the sidewall 14 respectively. Each of the protrusions 146 is arranged between the corresponding positioning column 122 and the corresponding platform 142.

Figure 3:
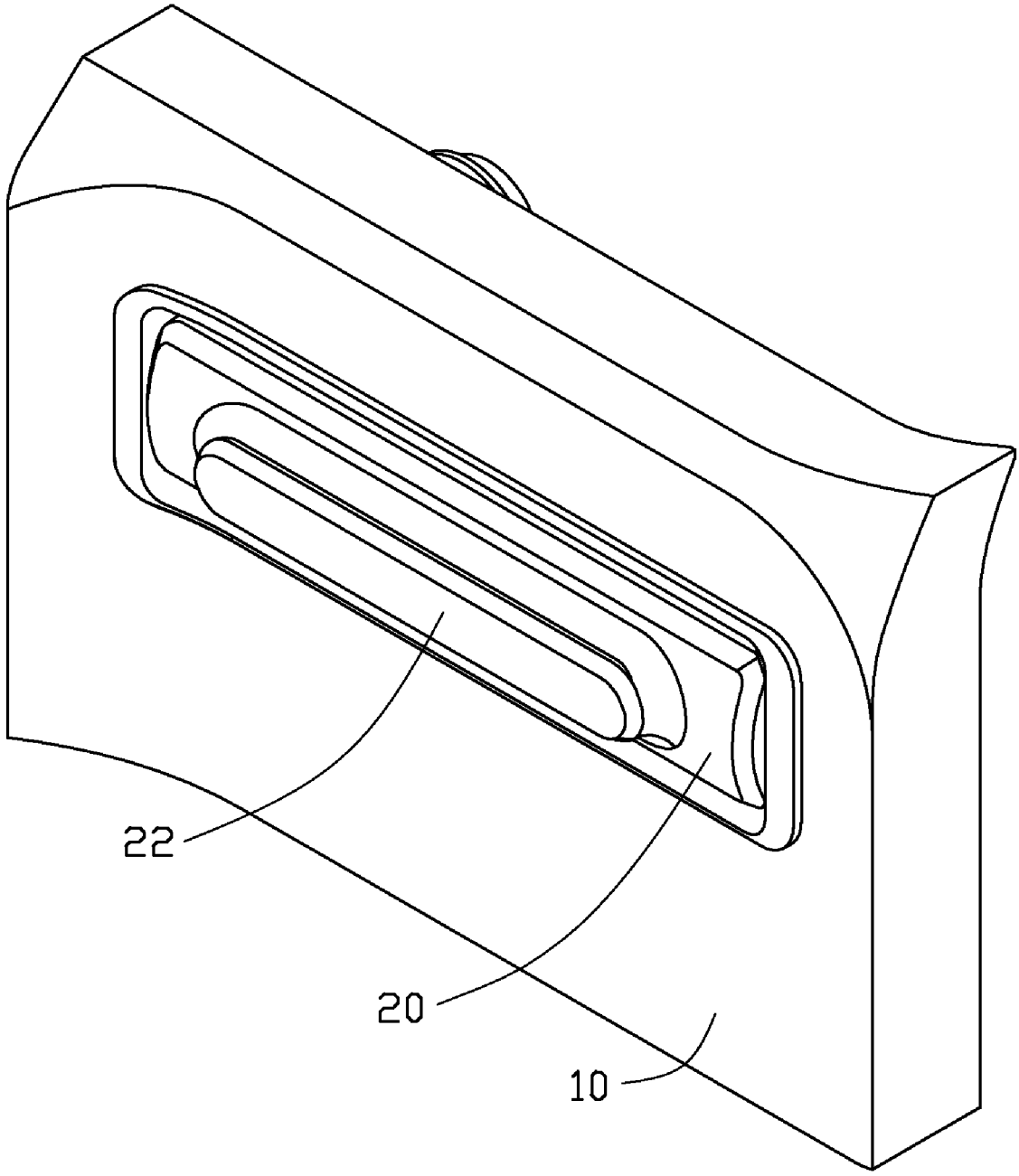
FIG. 3 is a back view of the button module in FIG. 1.

The button 20 is received in the opening 120 of the cover 10. The button 20 comprises a pivotal portion 24, an operating portion 22 (seen clearly in FIG. 3) formed at a rear side of the pivotal portion 24, and two posts 26 formed at a front side of the pivotal portion 24. A width of the pivotal portion 24 decreases gradually from the front side thereof to the rear side thereof. An elongated groove 240 is defined in the front side of the pivotal portion 24 and extends through two ends of the pivotal portion 24. A diameter of the groove 240 is similar to that of the pivots 140 of the cover 10 for pivotably engaging with the pivots 140. Two pairs of resisting portions 242 are formed at the two ends of the pivotal portion 24 respectively, and each pair of the resisting portions 242 is located symmetrically at two flanks of the groove 240 respectively. The resisting portions 242 partially extend into the groove 240 for preventing the pivots 140 sliding out of the groove 240. A rib 244 is formed in a center of the groove 240 for increasing strength of the button 20. The two posts 26 are respectively located at the two flanks of the groove 240 and located corresponding to the concave portions 148 of the sidewall 14. When the button 20 rotates relative to the pivots 140 of the cover 10, the posts 26 move to attach an inductor (not shown) of the camera to generate a signal of focusing.

The plate 30 is integrally made of a piece of elastic metal and secured on the front side of the cover 10. The plate 30 comprises a substantially rectangular body 32. Two positioning holes 320 are defined in two diagonal corners of the body 32 for positioning columns 122 of the cover 10 passing therethrough to position the body 32. An opening 322 is defined in a center of the body 32 corresponding to the opening 120 of the cover 10. Two ears 34 extend outwardly from two long sides of the body 32. Positions and configurations of the two ears 34 are corresponding to that of the platforms 142 of the sidewall 14. A through hole 340 is defined in each of the ears 34 for receiving one of the screws 40 therethrough to secure the plate 30 on the top of the sidewall 14. Corresponding to the concave portions 148 of the sidewall 14, two concave portions 348 are defined inwardly in the two long sides of the body 32.

Two elastic flakes 36 extend inwardly from the two long sides of the body 32 respectively, and have an identical configuration. The two flakes 36 are positioned corresponding to the two ears 34 respectively. Free ends of the two flakes 36 extend slantwise to a rear side of the body 32, to the pivotal portion 24 of the button 20. A hole 360 is defined in each of the flakes 36 for the corresponding post 26 passing therethrough.

Figure 4:
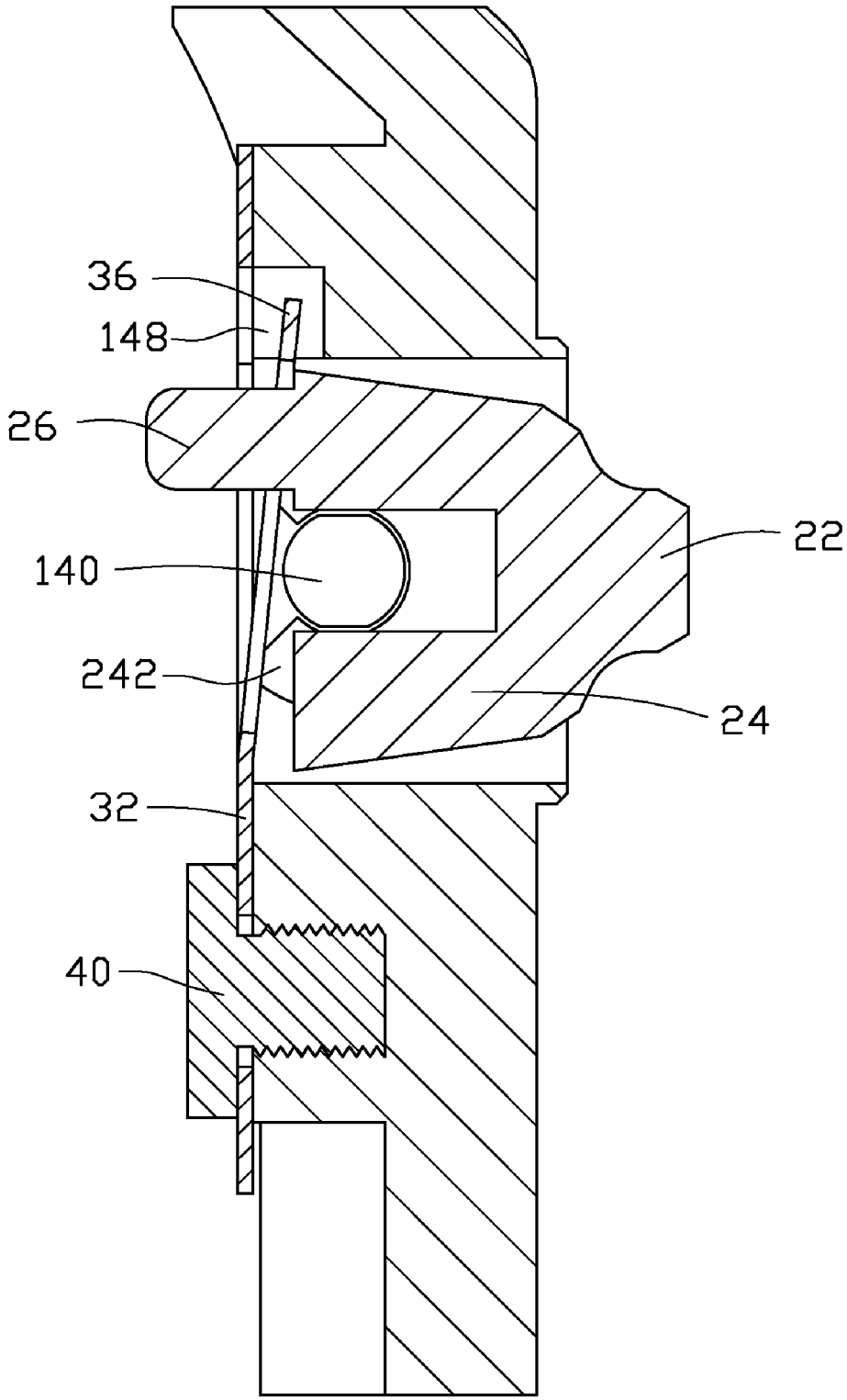
FIG. 4 is a schematic, cross-sectional view of the button module in FIG. 1, taken along line IV-IV, wherein a button thereof is at a first position.

Referring to FIG. 4, in assembly, the pivots 140 are received in the two ends of the groove 240 respectively, the button 20 is pivotably engaged with the cover 10; and then the positioning columns 122 of the cover 10 pass through the positioning holes 320 of the plate 30 to position the plate 30, and the plate 30 is secured on the sidewall 14 of the cover 10 by the screws 40. The resisting portions 242 prevent the pivots 140 sliding out of the groove 240. The operating portion 22 of the button 20 is exposed out of the rear side of the cover 10. The posts 26 of the button 20 pass through the holes 360 of the flakes 36 and extend out of the plate 30. Free ends of the flakes 36 are attached to the pivotal portion 24 of the button 20 and are received in the concave portions 148 of the sidewall 14.

Figure 5:
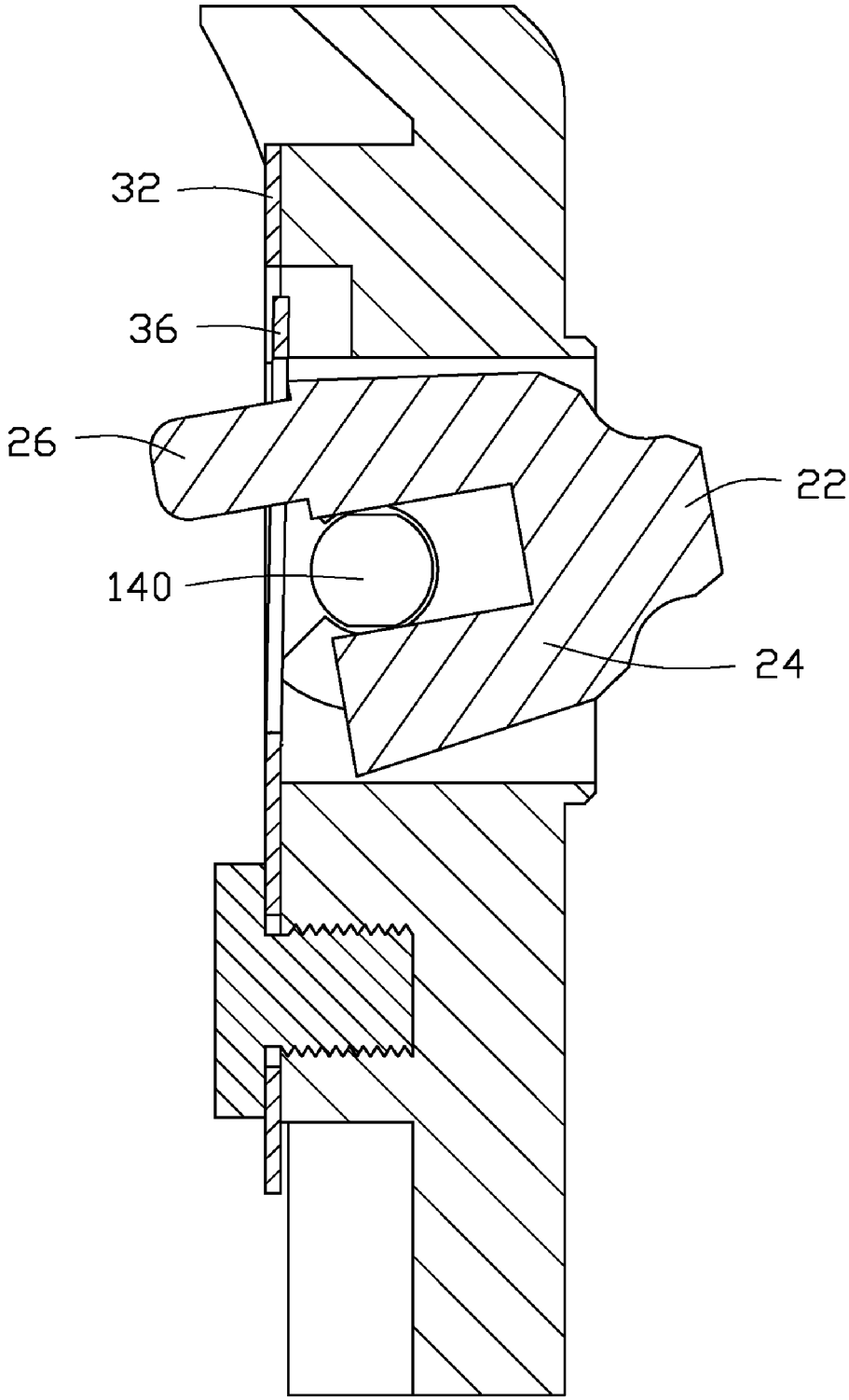
FIG. 5 is a schematic, cross-sectional view of the button module in FIG. 1, taken along line IV-IV, wherein the button thereof is at a second position.

In operation, the button 20 can rotate relative to the pivots 140 of the cover 10. The posts 26 can move to attach the inductor to generate controlling signals to complete a focusing process. In detail, again referring to FIG. 4, the button 20 is at a first position, and the flakes 36 of the plate 30 have no elastic distortion. As shown in FIG. 5, when the operating portion 22 of the button 20 is pressed by a user to a second position, the button 20 rotates anticlockwise relative to the pivots 140. One of the posts 26 moves from the first position to the second position completing a circuit (not shown) with the inductor to start the focusing process. One of the flakes 36 of the plate 30 corresponding to the one of the posts 26 is pressed by the pivotal portion 24 of the button 20 and generates an elastic distortion. The one of the flakes 36 of the plate 30 is substantially coplanar with the body 32 of the plate 30. When the operating portion 22 of the button 20 is released, a force generated by the elastic distortion of the one of the flakes 36 can rotate the button 20 clockwise relative to the pivots 140 and reset the button 20 from the second position back to the first position. Then the one of the posts 26 moves the inductor away to open the circuit to complete the focusing process.

Understandably, the button module of the present invention can be applied in other electronic devices such as digital videos, computers, digital music players and so on.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A button module adapted for using in an electronic device, comprising:

a cover defining an opening thereon a sidewall extending around the opening;

a button comprising a pivotal portion received in the opening of the cover for pivotably engaging with the cover; and an elastic plate secured on the cover and attaching to the button, the elastic plate comprising a body defining an opening therein corresponding to the opening of the cover and being secured on the top of the sidewall of the cover, and two elastic flakes extending inwardly and slantwise from the body;

wherein when the button moves relative to the cover from a first position to a second position, the plate generates elastic distortion and abuts against the button to reset the button to the first position.

2. The button module as claimed in claim 1, wherein the button is received in the opening and surrounded by the sidewall.

3. The button module as claimed in claim 2, wherein two pivots extend inwardly and symmetrically from two sides of the sidewall to insert into the button for the button rotating relative thereto.

4. The button module as claimed in claim 3, wherein the button further comprises an operating portion extending from a rear side of the pivotal portion, and two posts extending from a front side of the pivotal portion, the two posts extending out of a top of the sidewall of the cover.

5. The button module as claimed in claim 4, wherein a groove is defined in the pivotal portion and positioned between the two posts for pivotably engaging with the two pivots.

6. The button module as claimed in claim 5, wherein four resisting portions are formed at two ends of the front side of the pivotal portion, and each two of the resisting portions are located symmetrically at two flanks of the groove for preventing the pivots sliding out of the groove.

7. The button module as claimed in claim 6, wherein two platforms are outwardly formed on two other sides of the sidewall respective to the two sides on which the two pivots are formed, and two ears extend outwardly from two sides of the body corresponding to the two platforms of the sidewall, and a hole is defined in each of the ears and each of the platforms adapted for fasteners passing therethrough to secure the plate on the top of the sidewall.

8. The button module as claimed in claim 7, wherein two protrusions extend outwardly from the two other sides of the sidewall, and each of the two protrusions are located opposite to each of the two platforms.

9. The button module as claimed in claim 8, wherein two concave portions are defined inwardly in the two other sides of the sidewall and each of the concave portions are positioned corresponding to each of the protrusions.

10. The button module as claimed in claim 9, wherein each of the two flakes are positioned corresponding to each of the two ears, and free ends of the two flakes extend into the two concave portions of the sidewall.

11. The button module as claimed in claim 6, wherein free ends of the flakes extend to the button and attach to the pivotal portions of the button.

12. The button module as claimed in claim 11, wherein a hole is defined in each of the flakes for each of the posts passing therethrough, and when the posts with the pivotal portions move from the first position to the second position, the flakes are elastically distorted to reset the posts back to the first position.

* * * * *